United States Patent [19]

Bevers et al.

[11] 4,281,617

[45] Aug. 4, 1981

[54] APPARATUS FOR COATING CONDUCTORS

[75] Inventors: Robert C. Bevers, Doraville; Helmut E. Durr, Dunwoody; George E. Mock, Duluth, all of Ga.

[73] Assignee: Western Electric Company, Inc., New York, N.Y.

[21] Appl. No.: 105,465

[22] Filed: Dec. 19, 1979

[51] Int. Cl.[3] ..... B05C 3/172; B05C 11/02

[52] U.S. Cl. ..... 118/68; 118/125; 118/405; 118/DIG. 18

[58] Field of Search ..... 118/125, 405, DIG. 18, 118/DIG. 19, 404, 65, 68, 420

[56] References Cited

U.S. PATENT DOCUMENTS

| | | | |
|---|---|---|---|
| Re. 19,758 | 11/1935 | Underwood | 118/125 X |
| 1,747,475 | 2/1930 | Kempf | 118/405 |
| 2,698,983 | 1/1955 | Griffin | 118/DIG. 19 |
| 2,934,458 | 4/1960 | Budd et al. | |
| 2,943,598 | 7/1960 | Newton | 118/67 |
| 3,203,826 | 8/1965 | Stobierske . | |
| 3,346,413 | 10/1967 | Lindemann | 118/125 X |
| 3,533,761 | 10/1970 | Pierson | 118/405 X |
| 3,741,153 | 6/1973 | Sears et al. | 118/405 |
| 3,763,554 | 10/1973 | Early . | |
| 3,877,975 | 4/1975 | Raymond | 118/405 X |
| 4,191,127 | 3/1980 | Herman | 118/125 X |

FOREIGN PATENT DOCUMENTS 1401931 8/1975 United Kingdom .

OTHER PUBLICATIONS

Western Electric *Microphone*, Sep., 1978, p. 10.
Western Electric *Microphone*, Sep., 1979, p. 3.

*Primary Examiner*—John P. McIntosh
*Attorney, Agent, or Firm*—E. W. Somers

[57] ABSTRACT

An apparatus for applying a relatively thin uniform thickness layer of a fluent coating material to each of a plurality of conductors includes a housing having aligned entrance and exit openings. An applicator tube is mounted within the housing transverse of the paths of the conductors and includes a plurality of spaced applicator openings through which the conductors are advanced. The tube is arranged so that each applicator opening includes aligned notches in front and rear walls of the tube and a slot in the top of the tube, the slot connecting an aligned pair of notches. The fluent coating material is supplied to the tube and is maintained at a level substantially at the top of the tube so that as the conductors are advanced through the applicator openings they are immersed in the coating material. After the coated conductors leave the applicator tube, but while still within the housing, they are advanced through individually mounted dies which remove excess coating material to control the thickness of the layer. The apparatus is arranged and constructed of materials which together minimize any accumulation of excess coating material between the time it leaves the applicator tube and or dies and its collection within the housing for return to a recirculation system.

8 Claims, 6 Drawing Figures

APPARATUS FOR COATING CONDUCTORS

TECHNICAL FIELD

This invention relates to an apparatus for forming a uniform coating about a moving conductor, and more particularly, to an apparatus for applying a coating having a uniform thickness to each of a plurality of metallic conductors, said coating when at least partially treated being capable of adhering a pulpous material to the conductors.

BACKGROUND OF THE INVENTION

One of the principal insulation materials for conductors used in telephone communication systems is a pulpous material which tends to absorb moisture to which a cable may be exposed, thereby avoiding degradation of transmission signals. Water which enters a pulp-insulated multipair cable causes the pulp to swell, which localizes the water at a fault point that is detectable by routine tests. Pulp-insulated cable advantageously is low in cost, provides more conductors for a given cable diameter than other kinds of cable, and has a continuing availability as opposed to sources for a petroleum derivative from which plastic insulating materials are made.

Pulp-insulated conductors are generally produced in a continuous process in which many conductors, often as many as sixty, are passed through an electrolytic cleaner, coated with a wet pulp layer, and drawn through a drying oven in order to produce a pulp-insulation cover having a final moisture content in the range of 7 to 10% on each of the conductors. A detailed description of a pulp-insulating process can be had by referring, for example, to an article "Manufacturing Pulp Cable," on pages 86–94 of the July–October 1971 issue of *The Western Electric Engineer.*

One of the problems in pulp-insulated conductors is the occurrence of uninsulated areas along the conductors, particularly in the final cable structure. These may occur either because of a lack of adherence of the pulp to the conductor during insulating or because of the abuse to which the insulation is subjected in steps of a cable-making process subsequent to insulating. Conductors which have a predetermined number of such defects occupy a part of and increase the size of the cable cross-section without contributing to its utility since they are unuseable for telecommunications. Unfortunately, an increased cross-section requires additional plastic jacketing material and underground duct capacity without any offsetting benefit.

Another problem relates to the strength characteristics of pulp insulation and the effects of these on the electrical properties of pulp-insulated conductors. When two insulated conductors are associated together to form a twisted pair, their centers are separated by a distance which has an inversely proportional effect on mutual capacitance. Because the crush resistance of conventional pulp-insulation having a residual moisture content is relatively low, one or both of the conductors may have its insulation deformed when subjected to the rigors of other manufacturing processes such as, for example, twisting. This generally causes the distance between conductor centers to be decreased with an accompanying undesirable increase in mutual capacitance. While this problem could be overcome by reducing the residual moisture content, the resulting pulp insulation would have unacceptable flexibility and endurance characteristics.

These problems have been overcome by a process which is disclosed in commonly assigned application Ser. No. 951,808 filed Oct. 16, 1978 now U.S. Pat. No. 4,218,285 which issued on Aug. 19, 1980 in the names of H. E. Durr and James G. Wright, Jr. The pulp is treated to optimize its resistance to deformation in subsequent processing and during installation to preserve acceptable mutual capacitance properties, without causing the pulp to become brittle and impair the integrity of the insulative cover. In that process an electrical conductor is enclosed in a coating which is capable of being treated so that it is substantially insoluble in water, and which when covered with pulpous material is capable of being further treated to create an adhesive bond between the pulpous material and the conductor. The coated conductor is treated to render the coating substantially insoluble in water after which it is enclosed in a pulpous material having a relatively high moisture content. The coating and the pulpous material are further treated to reduce substantially the moisture content of the pulpous material and to tackify the coating which cause the crush resistance to be increased and the pulpous material to adhere to the conductor to form an insulative cover having substantial integrity.

The material which is coated on the conductors prior to the application of pulpous material is an acrylic latex material which tends to harden as it engages a surface. Further, as additional material runs over existing material, it tends to build up since it tends to adhere to itself more rapidly than to surfaces. This behavior by the latex material causes problems during its application to the conductors. Desirably, an apparatus for its application to a plurality of conductors is such that the area of surface contact with the material is controlled to minimize build up.

In the prior art, apparatus which sprays material on moving conductors is known but sprays are not easily controllable, especially for small gauge conductors. Rollers have been used to apply a coating from a bath to a conductor which is advanced thereover at a tangent point of engagement. However, neither of these techniques is likely to result in a uniform thickness coating on each of a plurality of conductors being advanced along parallel paths.

An apparatus shown in U.S. Pat. No. 2,943,598 insulates a wire by moving a wire in a plurality of passes along inclined paths through a notched weir which is mounted on each side of an oven. While multiple passes are necessary to provide an insulation cover on a conductor instead of causing undue sag of the coating material in a single pass between an applicator and an oven, such an arrangement is not feasible in a pulp insulating line, which includes other equipment, for the simultaneous coating of a plurality of conductors with a precise thickness layer which will not adversely affect the dielectric properties of the pulp-insulated conductors.

The prior art also seemingly lacks a coating apparatus which is capable of simultaneously providing each of a plurality of conductors with a uniform thickness layer while avoiding undue build-up of coating material on the apparatus which otherwise would impair the efficiency of the apparatus.

SUMMARY OF THE INVENTION

The foregoing problems are solved by the apparatus of this invention which provides a uniform thickness of coating of a fluent material on each of a plurality of moving conductors while avoiding undue build up of the material on portions of the apparatus. The apparatus includes a housing having openings through which a conductor may be advanced along a path into and then out of the housing. Non-contacting means is mounted in the housing for applying the fluent material to the conductors and has openings which are aligned with the openings in the housing through which the conductor is moved. The non-contacting means maintains the coating material at a level above the conductor along said portion of its path to apply a coating to the conductor as it is moved therethrough. A die is aligned with the openings of the applying means for removing excess coating material to form a layer of the coating material about the conductor such that the layer has a substantially uniform thickness. The openings in the non-contacting means and the level of the coating material therein relative to the path of the conductor insures that sufficient coating material is applied to the conductor so that the die is flooded as the conductor is advanced therethrough.

The coated conductor is moved out of the housing and through a device which treates the coating material to render it substantially insoluble in water so that it can be advanced through a pulp-vat wherein a pulpous ribbon is formed along the conductor. Subsequently, after the ribbon has been formed into a cover which is disposed concentrically about the coated conductor, the insulated conductor is advanced through facilities which further treat the coating material to tackify it and cause the pulpous material to be adhered to the conductor to form a pulp insulative cover having substantial integrity.

BRIEF DESCRIPTION OF THE DRAWINGS

Other features of the present invention will be more readily understood from the following detailed description of specific embodiments thereof when read in conjunction with accompanying drawings, in which.

DETAILED DESCRIPTION

Figure 1:
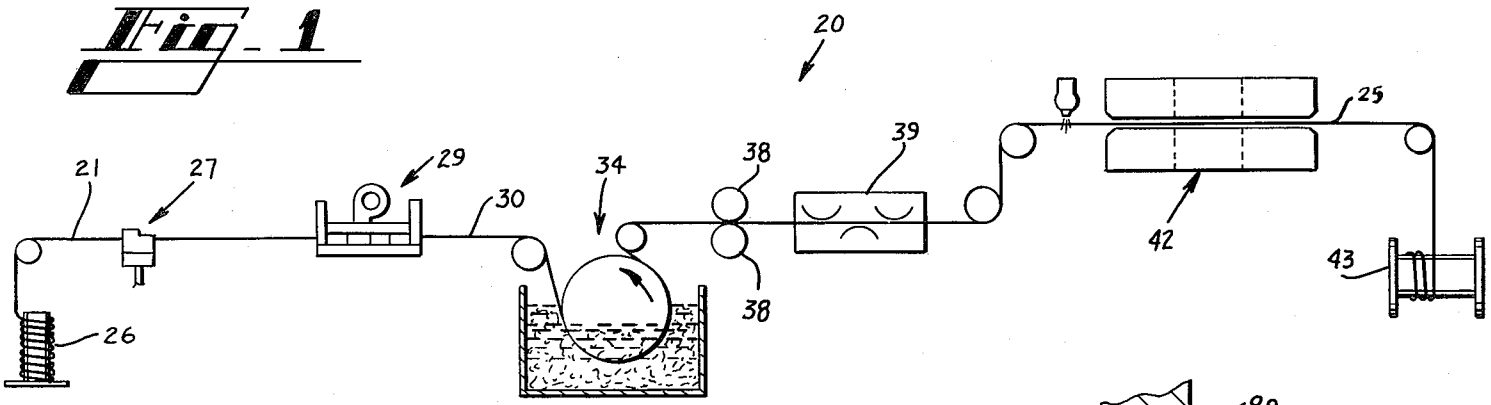
FIG. 1 is an overall schematic view of a pulp-insulating line which includes the apparatus of this invention.

Referring now to FIG. 1, there is shown a manufacturing line, designated generally by the numeral 20, for carrying out a process for pulp-insulating a copper conductor 21. A plurality of copper conductors 21—21 from a supply 26 are advanced through an apparatus of this invention which is designated generally by the numeral 27 which applies a fluent coating material 28 to each conductor that is dried partially in an oven 29 to form a coated conductor 30. This coating 28 is a material which is capable of bonding pulpous material to the conductor 21.

Figure 2:
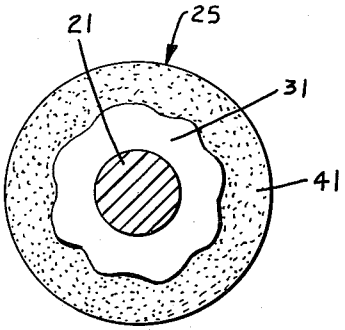
FIG. 2 is a cross-section end view of a pulp-insulated conductor which is made with the apparatus of this invention.

The coated conductors 30—30 are moved through a conventional cylinder type pulp apparatus 34 where they are centered in wet ribbons of pulpous stock which are being formed continuously. Press rolls 38—38 apply compressive forces to the composite ribbons 35—35 and conductors 30—30 to reduce the moisture content of the pulpous material. Then the ribbons are spun about the conductors by polishers 39—39 to form pulp-covered conductors 25—25 (see FIG. 2) each of which comprises a tube 41 of pulp insulation. The pulp-covered conductors 25—25 are moved through an oven 42 in which the coating 28 and the pulp insulation undergo further changes, and is then taken up on reels 43—43 for use in subsequent operations.

Figure 3:
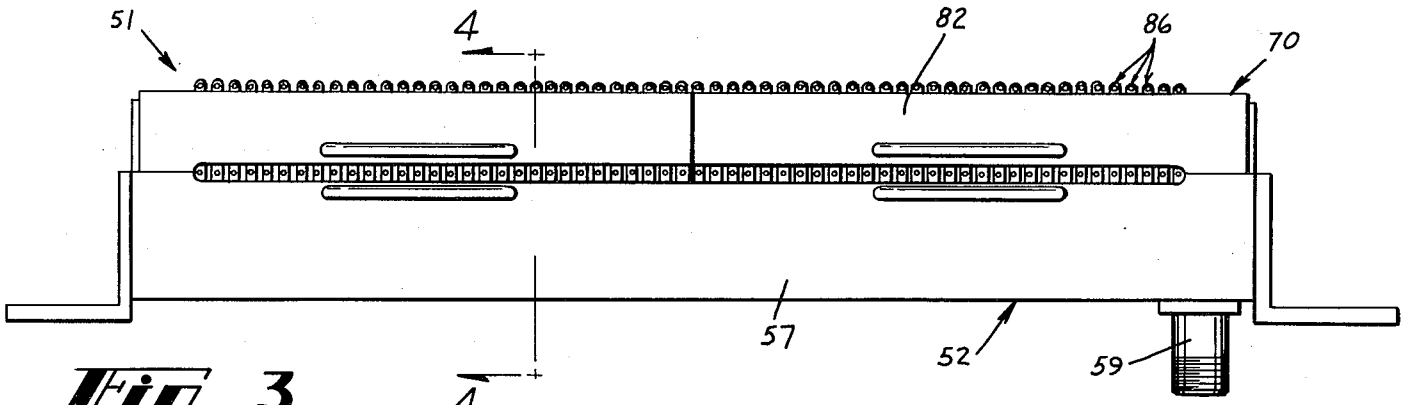
FIG. 3 is an elevational view of the apparatus of this invention for applying a uniform coating to each of a plurality of conductors prior to each being enclosed in a cover of pulpous stock.
Figure 4:
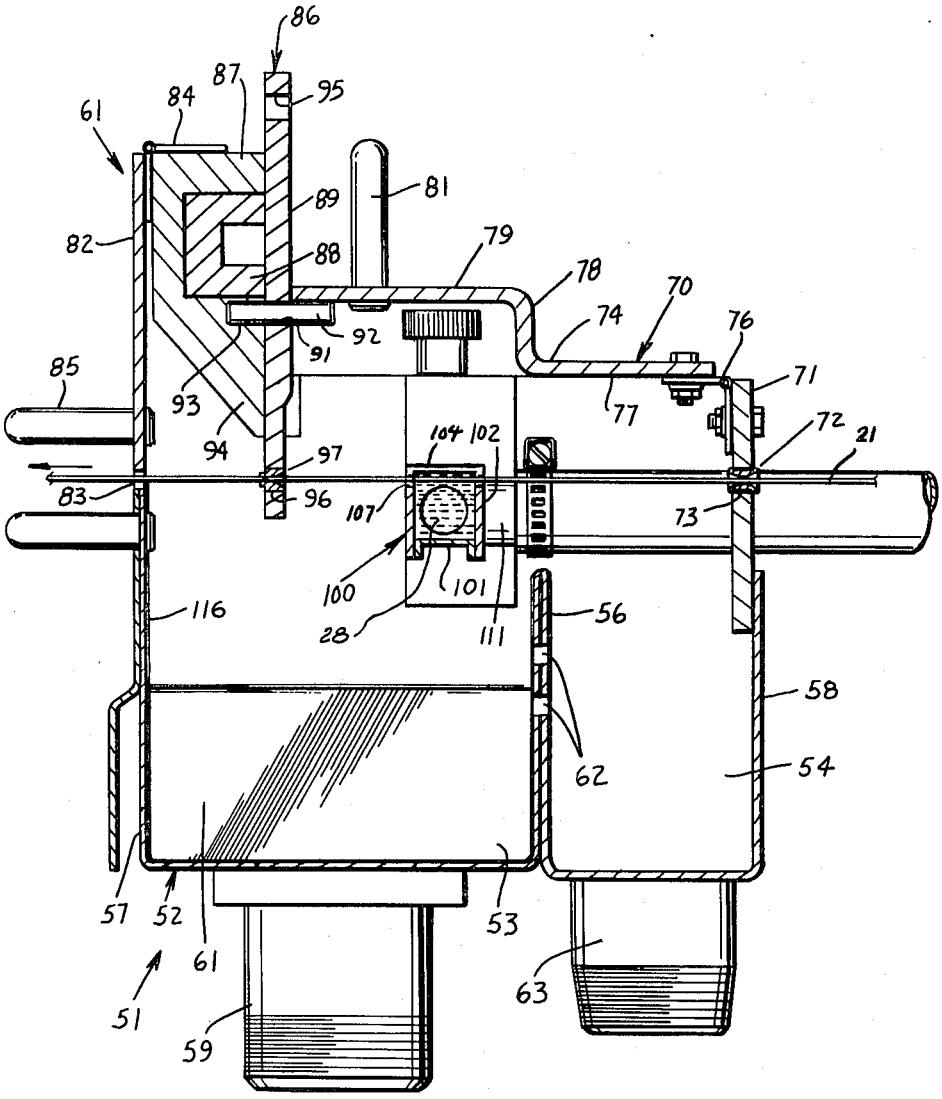
FIG. 4 is a cross-sectional end view of the apparatus shown in FIG. 3.

Turning now to FIGS. 3-4 and the apparatus 27 of this invention for applying the coating material 28 such as, for example, an aqueous emulsion of acrylic polymer to a plurality of conductors 21—21, a housing, designated generally by the numeral 51, includes a base 52 which is formed into side-by-side U-shaped compartments 53 and 54 with a common wall 56. The compartment 53 includes a front wall 57 while the compartment 54 is formed with a rear wall 58. The compartment 53 functions as a collection tank for spent coating material which is returned along a sloped floor 61 and through a drain 59 to a recirculating system (not shown). In order to prevent leakage of the adhesive material from openings in a front wall 57 of the compartment 53, the common wall 56 is formed with a plurality of openings 62—62 to permit adhesive material to flow into the compartment 54 and out a drain 63.

The housing 51 also includes an upper portion designated generally by the numeral 70 which includes a rear wall 71 having a plurality of openings 72—72 found therein. A guide 73 which is made of a ceramic material and which has an opening with a diameter slightly greater than the diameter of the largest expected gauge size conductor is mounted in each of the openings 72—72 in the rear wall 71. In order to provide access to the interior of the housing of the upper portion 70 includes a lid 74 which is mounted pivotally to the rear wall 71 through a hinge 76 that is attached to a lower portion 77 of the lid. The lid 74 is formed with a step 78 that connects the lower portion 77 to a top portion 79. A handle 81 is attached to the top portion 79 to facilitate the pivotal movement of the lid 74 and the exposure of the interior of the housing 51.

The upper portion 70 of the housing 51 also includes a pivotally mounted front plate 82 that extends toward a top of the plate 57 of the base 52 and cooperates therewith to form a slotted opening 83 through which the coated conductors 21—21 are advanced out of the housing. A hinge 84 is attached to the plate 82, which may be swung outwardly by a handle 85, and to a die assembly, designated generally by the numeral 86.

Figure 5:
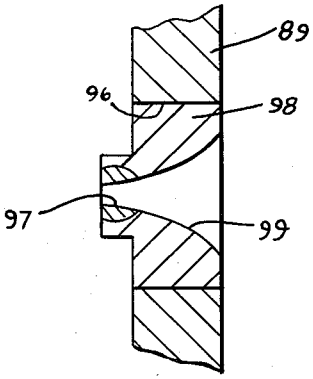
FIG. 5 is an enlarged view of one of a plurality of dies which comprise a portion of the apparatus of FIG. 3.

The die assembly 86 includes an angled block 87 to which is attached the hinge 84 and to which a U-shaped magnet 88 attached. The magnet 88 is in engagement with a plurality of vertically disposed, spaced, generally rectangular die holders 89—89 which extend above the block 87 and which depend downwardly into the housing 51. Each of the die holders 89—89 includes an opening 91 in which is received a horizontally disposed pin 92 that extends forwardly into an opening 93 formed in a lower portion of the support block 87 and rearwardly to function as a support for the free longitudinal edge portion of the lid 74. The magnet 88 and the pins 92—92 cooperate to maintain the die holders 89—89 spaced along the housing in engagement with the vertical face of the block 87. Openings are formed in end portions of each die holder 89 with an opening 95 in that end portion of each die holder which extends outwardly from the block 87. In the lower end portion of each of the die holders 89—89, there is an opening 96 in which is received a diamond die 97 which is mounted in a stainless steel bushing 98 (see FIG. 5). Each of the dies 97—97 is formed as shown in FIG. 5 and provides a flared opening 99 for receiving a coated conductor 21 and the sized opening of the die 97 for removing excess coating material from the conductor. This arrangement results in a conductor 21 which is coated with a layer 31 having a substantially uniform thickness. The holders 89—89 are arranged so that the die openings 98—98 and 99—99 are aligned with the guide bushings 73—73 and the slotted openings 83—83 in the front plate 82 of the housing 51.

The mounting of the dies 97—97 in individual holders 89—89 is advantageous from the standpoint of down time on the manufacturing line 20 which includes the apparatus 27. Should one of the dies 97—97 need replacing, a new die may be mounted in the opening 95 and the holder inverted so that the worn die is accessible outside the housing 51 while the new die is in an operating position aligned with an applicator opening of the tube 100. Or, should it be necessary to perform specific maintenance operations on a particular die holder 89, it can be removed from the housing 51 without interrupting the processing of the remainder of the plurality of conductors 21—21.

The dies 97—97 perform several important functions. First, they control the thickness of the layer 31 of coating material on each conductor 21. This is important to the control of the overall diameter-over-dielectric (DOD) of the insulated conductor as well as insuring that the dielectric properties of the insulated conductor are not adversely affected because of an unduly thick coating. Secondly, the dies 97—97 prevent the passage therethrough of tangled portions of the conductors 21—21 as well as conductor splices which are misaligned. Also since the dies 97—97 are sized to accommodate a particular gauge conductor, the dies will prevent passage of a splice at which an operator inadvertently had joined a larger gauge conductor to a trailing end of a smaller gauge conductor. In these instances, the conductor 21 breaks at the die 97, but much less effort is required to restring the line because of such an occurrence than if the conductors had gone through the pulp vat or simply went undetected while being insulated.

Figure 6:
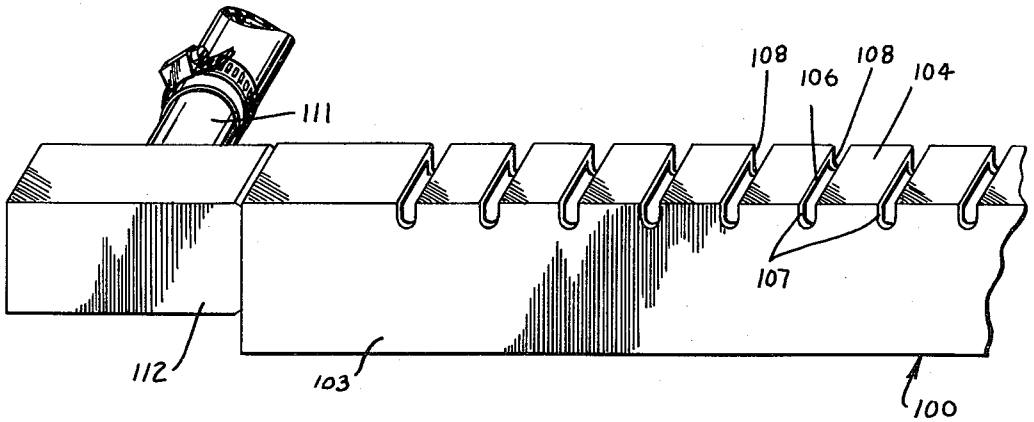
FIG. 6 is a perspective view of a portion of the apparatus of FIG. 3.

The application of the fluent coating material to the conductors 21—21 is accomplished with an applicator tube which is designated generally by the numeral 100 and which is mounted in the housing 51 (see FIGS. 4 and 6). The application tube 100 is constructed with a base 101, a rear wall 102, a front wall 103 and a cover plate 104. As can best be seen in FIG. 6, the cover plate 104 is formed with a plurality of openings or slots 106—106 which are spaced therealong with each opening being aligned with a die 97 and associated guide bushing 73. Further, the front wall 103 and the rear wall 102 are each formed with a plurality of spaced notches 107—107 and 108—108, respectively, with each of the notches 107 being aligned with one of the notches 108. Each set of aligned notches 107 and 108 communicates with the top of the applicator tube 100 through an associated one of the slots 106—106.

While each of the applicator openings formed by a notch 107, an aligned notch 108 and an associated slot 106 must be large enough to accept the largest anticipated gauge size conductor, they must not be so large as to adversely affect the control of the level of the fluent coating material in the tube 100 and the thickness of the coating on the conductor 21. If these openings were oversize, it would be difficult to maintain that level substantially adjacent the top 104 without substantially increasing the flow rate of the coating material. Moreover, the larger these openings, the less the amount of the coating material which is pulled along with the conductors 21—21 as they pass out of the notches 107—107.

Each end of the applicator tube 100 is supplied with a fluent coating material which is flowed thereinto by feeder tube 111 and redirection coupler 112. This dual feeding of the applicator tube helps to assure a balanced flow therealong and uniformity of supply to each of the applicator openings.

The conductors 21—21 are advanced through the tube 100 in a manner to insure a coating of its entire circumferential surface along a portion of its path which is sufficient to avoid bare spots. The path of each conductor is along a centerline of the aligned associated notches 107—107 and 108—108 and is somewhat below the cover plate 104. This causes the conductor 21 to be immersed in the liquid coating material throughout its travel across the width of the applicator tube 100.

The immersion of each conductor along a portion of its path insures that sufficient coating material is applied to the conductor so that when it is moved through its associated die 97, the flared opening thereof is flooded. This permits the die 97 to remove excess material in such a manner that the final coated layer 31 has a substantially uniform thickness.

As can be surmised, some of the fluent coating material flows from the applicator tube 100 out of the notches 108 and 108. Also, some of the material is caused to be pulled out through the notches 107—107 by the moving conductors 21—21. However, because of the circulatory system and because of capillary action, the level of the fluent coating material substantially at the level of the cover plate is maintained.

The fluent material that is applied to the conductors 21—21 by the apparatus of this invention is such that when initially treated, such as, for example, by exposure to a first temperature for a predetermined time, it becomes capable of remaining on the conductor 21 while the pulpous material is applied thereover, and when further treated, such as, for example, by exposure to a second temperature for a predetermined time, it enhances the adhesive bond between the pulpous material and the conductor. Further, the coating material must be such that when initially treated, e.g. when it is partially cured or dried, it may be somewhat tacky but it does not peel off the conductors 21—21 when, for example, the conductors are moved into and out of engagement with portions of the apparatus 20. It has been found that an acrylic adhesive, and, more particularly, an aqueous emulsion of an acrylic polymer is ideal for purposes of this invention. An acrylic copolymer such that marketed by Rohm and Hass Company under the designation HA-12 and having a solid content of 45% has been found to be especially suitable.

One disadvantage of the use of the above-described preferred coating material is that when it flows over surfaces, it tends to dry and build up. The arrangement for applying the latex material to the conductors 21—21 is such that its engagement with surfaces is controlled in order to minimize the build-up of the latex material on surfaces of the apparatus. This is accomplished, for example, by minimizing exposure of the latex material itself to the atmosphere to prevent its drying. Also of help in this regard is the design of the apparatus to minimize the path of the latex material from the applicator tube 100 along surfaces where it could dry prior to its collection in the compartments 53 and 54.

Another problem which is overcome by the apparatus of this invention is caused by the corrosiveness of the acrylic latex material which is used to coat the conductors 21—21. Although that material is suitable for adhering the pulpous stock to the conductors 21—21 and is capable of being partially dried to prevent its removal in the pulp vat, it would quickly corrode other than specially resistant material such as stainless steel used to construct the housing 51. It has been found that corrosion is prevented by coating all surfaces which are exposed to the acrylic latex material with a non-corroding material 111 such as, for example, TEFLON ®-S flurocarbon marketed by DuPont Co. of Wilmington, Del.

The use of a material such as, for example TEFLON ®-S plastic, to coat the surfaces of the housing 51 which are exposed to the acrylic latex provides an unexpected advantage. It will be recalled that because of the propensity of the latex material to dry quickly and coagulate on surfaces, the apparatus was designed to minimize the length of the path of runoff of the latex material along surfaces. It has been found that a suitable non-corroding material such as the TEFLON ®S coating causes the latex material to run off these surfaces more rapidly which reduces contact time and contributes significantly to the reduction of latex build-up. Even though a stainless steel housing 51 would resist corrosion, the stainless steel does not, unlike the TEFLON ®plastic, accelerate runoff of the coating material.

Another disadvantage of the preferred coating material is that it has a substantially higher dielectric constant than pulpous material and than air which in a conventional pulp-insulated conductor forms part of the interface between the pulp and the conductor 21. However, the use of the applicator tube 100 and the dies 97—97 permits substantially precise control of the thickness as well as the uniformity of the coating 28 on the conductors 21—21 and minimizes any adverse effect on the electrical properties of the pulp-insulated conductors 25—25.

After the conductors 21—21 have been coated with a layer of an aqueous emulsion of acrylic latex, they are advanced through the oven 29, which is designed to partially dry the latex. The partial drying of the latex or other suitable liquid coating material will cause a removal of the solvent or carrier and for the latex will initiate a curing process. From the oven 29, the conductors 30—30 are moved into the single cylinder paper-forming apparatus 34 where refined pulp is formed into ribbons 35—35. After forming, the wet, paper-pulp ribbons 35—35 with the adhesively coated embedded conductors are transferred from the cylinder mold to a continuous fabric belt (not shown) and passed through the pair of rubber-covered press rolls 38—38 where the excess water is removed to reduce the moisture content of each of the pulp ribbons 35—35 to about 80%. The ribbons 35—35 which are moved out of engagement with the press rolls are about 0.79 cm wide and form an insulation thickness that varies from 0.18 to 0.41 mm depending on conductor size.

Then a plurality of the wet ribbons 35—35 having the conductors 30—30 embedded therein are turned around the conductors by passing them through the high speed rotating polishers 39—39 (see FIG. 1), which are conventional in the art, to form a layer 41 (see FIG. 2) of pulp insulation having a moisture content of about 70% about each conductor. The wet insulation 41 is dried to a final moisture content of about 3 to 6% and the layer 31 is further treated by passing the pulp-insulated conductor 41 through the oven 42. As each conductor 21 is advanced through the final oven 42, the adhesive coating cures, especially at the interface with the pulp layer 31. The exposure for a predetermined time to the temperatures within the furnace 42 further tackifies the coating 28 and permits pulpous material to penetrate into and become adhered thereto.

This results in a pulp-insulated conductor 25 in which there is no well-defined interface between the initial latex adhesive coating 28 and the pulp layer 31, but rather an apparent intermingling thereof for some distance into the pulp 36. Advantageously, the invention provides a pulp-insulated conductor 40 having greatly improved crush resistance and flexibility endurance thereby assuring substantial insulation integrity and avoiding the formation of bare wire during the subsequent processes to which the pulp-insulation is subjected.

The thickness, density and amount of moisture in the pulp insulation are important insofar as capacitance requirements of a pulp-insulated cable are concerned. As will be recalled, pulp thickness has an inverse effect of mutual capacitance and excess moisture causes soft pulp which can be easily deformed thus affecting uniform capacitance distribution. When such conductors 22—22 were subjected to the rigors of twisting and stranding, the insulation compacted, causing the conductors to be deformed and eccentric with respect to the insulation thereby decreasing the distance therebetween. This undesirably increased the mutual capacitance between the conductors. While deformation can be substantially prevented by a higher degree of drying of the pulp to perhaps 3 to 6%, the result is an extremely brittle insulation which literally degrades on the conductors during twisting. Dry fibers tend to be brittle, but water-soaked fibers are flexible because they have taken up water which makes them soft and pliable, increases their elasticity and plasticity, and decreases their stiffness. Since the insulation 41 of the pulp-insulated conductor 25 has superior adhesion to the conductor 21, it has been found that the moisture content can be further reduced to the 3 to 6% range which prevents compacting of the insulation during twisting.

Example

A plurality of 26 gauge copper conductors 21—21 having an outside diameter of about 0.4 mm were advanced at a line speed of about 61 meters per minute into the applicator tube 100 which applied a coating of acrylic latex HA-12 to each of the conductors. The flow rate of the coating material into the applicator tube was about 3.8 liters per hour. The applicator tube 100 was constructed to include a plurality of applicator openings each comprising aligned notches 107 and 108 connected by a slot 106. Each notch had a width of about 0.30 cm and a depth of about 0.43 cm. Each slot was about 1.91 cm in length and about 0.30 cm in width. Surfaces of the applicator tube 100 and housing 51 were coated with TEFLON ®S plastic. The coated conductors were advanced through sizing dies which were spaced about 2.5 cm from the applicator tube and which caused the coating to be about 0.013 mm thick on each conductor. The conductors were then moved through an infra-red drying oven which was spaced about 61 cm from the housing 51 and which included four banks of twleve lamps which were effective at a temperature range of 260° C. to 370° C. to partially dry the acrylic latex so that as the conductors exited from the oven, the layer 31 was about 0.005 mm thick. The adhesively coated conductors 21—21 were moved around the cylinder 93 in the pulp vat 94 where each conductor was embedded in a ribbon 35 of pulpous material 36 such that the moisture contact of the pulp ribbon was about 80% by weight. The conductors 21—21 were moved between the press rolls 38—38 which caused the moisture content to be reduced to about 70% by weight after which the conductors were moved through the polisher 39 which formed the ribbons 35—35 into concentrically disposed sheaths of pulp insulation. From the polishers 39—39 the conductors were moved into and through the final oven 42. Initially, the conductors were exposed to a temperature of 654° C. and finally to a temperature of about 530° C. The moisture content of the pulp insulation as the conductors were advanced out of the oven was in the range of 4 to 6% by weight while the diameter-over-dielectric of the pulp insulated conductor was about 0.79 mm. The weight of the insulation was found to be about 184 grams per meter.

Test Results

The results of tests for conductors 21—21 which have been coated with an acrylic latex material in accordance with this invention are demonstrably better than those for conductors insulated with pulp by conventional processes. For example, a 26 gauge conductor with conventional pulp insulation had a crush resistance in the range of 63 to 120 newtons and an average value of 98 newtons while insulation made in accordance with this invention had a crush resistance in the range of 76 to 187 newtons and an average value of 125 newtons. A force of less than 6 newtons was required to overcome the adhesion of a predetermined length of conventional pulp insulation from a 26 gauge conductor while 19 newtons were required for the insulation of this invention.

Flexibility endurance of pulp insulation is measured by the number of cycles a length of pulp-insulated conductor can be wound onto and unwound from a mandrel having a predetermined diameter. A sample comprising nine lengths of a 26 gauge conductor insulated by a conventional process withstood an average of 2 cycles before all of the sample displayed bare spots whereas the count increased to an average of 3.3 for conductors insulated in accordance with this invention. For 24 gauge conductors, these values were 2.5 cycles and 3.8 cycles, respectively.

The improvements are even more pronounced with respect to the integrity of the insulation cover on the conductor. For example, at the twisting operation, standard pulp-insulated conductors 22—22 showed 4.5% shorts and 4.0% chips compared to 0 and 1.2% for the conductors 25—25. At stranding, shorts occured at 0.92 per MCF (million conductor feet) for standard pulp conductors versus 0 per MCF for the conductors 25—25 whereas shorts at cabling decreased from 0.22 per MCF to 0 per MCF. In a final cable produced in accordance with this invention, shorts dropped from 0.53 per MCF to 0 while the number of opens dropped from 0.07 per MCF to 0.

It is to be understood that the above-described arrangements are simply illustrative of the invention. Other arrangements may be devised by those skilled in the art which will embody the principles of the invention and fall within the spirit and scope thereof.

What is claimed is:

1. An apparatus for providing a uniform thickness layer of a fluent coating material to a moving conductor, said apparatus comprising:

a housing having openings through which a conductor may be advanced along a path into and then out of said housing;

non-contacting means mounted in said housing and having openings aligned with the openings in said housing through which the conductor is moved along a portion of the path for holding the coating material and for maintaining the coating material at a level above the conductor along said portion of its path to cause the coating material to be applied to the conductor as it is moved therethough, said non-contacting means including an applicator tube which comprises:

a container for the fluent coating material, said container including a pair of spaced side walls, each side wall having a notch formed therein, said notches being aligned with a path of travel of a conductor through the notches such that the conductor is not contacted by the surfaces of the walls which form the notches; and a cover having a plurality of slots thereacross, each said slot connecting a pair of aligned notches in said side walls and being parallel to a conductor path, each said slot and aligned notches forming an applicator opening which is sized to accommodate a range of conductor sizes and to maintain the level of the coating material in said container substantially at a predetermined level above the path of the conductor without substantially increasing the flow rate of the coating material into said container;

die means aligned with an exit opening in said non-contacting means for removing excess coating material from the conductor to form a layer of substantially uniform thickness;

means for partially treating the coating material; and means for advancing the conductor into said housing, through said non-contacting means and said die means and then out of said housing and through said treating means.

2. The apparatus of claim 1, wherein said coating material is an acrylic latex material and wherein said treating means includes heating means and said housing includes means interposed between said die means and said heating means to prevent said heating means from causing the material on an exit end of said die means in said housing to dry.

3. The apparatus of claim 1, wherein the level of the fluent material in the container is above the lower portions of the notches, the conductor being immersed in the fluent material in the portion of the path of travel between said notches.

4. The apparatus of claim 1, wherein the coating material is an acrylic latex material and wherein surfaces of said die means and said non-contacting means over which spent acrylic latex material flows before its descent into said housing are formed to minimize the length of travel of said spent material to minimize any accumulation thereof on said surfaces.

5. The apparatus of claim 4, wherein said housing substantially encloses said non-contacting applying means to prevent exposure of said coating material to the atmosphere before its application to the conductor.

6. The apparatus of claim 1, wherein said die means includes a plurality of elongated die holders, said die holder having an opening in each end thereof and a die mounted in one opening of each said die holder, said apparatus further including means for mounting said means to align said die of each holder with an associated pair of aligned notches in said applicator tube.

7. The apparatus of claim 6, wherein each said die holder is capable of being individually removed from said apparatus.

8. The apparatus of claim 1, wherein surfaces of said apparatus which are contacted by said coating material are coated with a non-corroding material which inhibits accumulation of the coating material on surfaces of said apparatus.

* * * * *

UNITED STATES PATENT AND TRADEMARK OFFICE

CERTIFICATE OF CORRECTION

PATENT NO. : 4,281,617

DATED : August 4, 1981

INVENTOR(S) : R. C. Bevers, H. E. Durr, G. E. Mock

It is certified that error appears in the above—identified patent and that said Letters Patent is hereby corrected as shown below:

In the claims, Column 10, claim 1, line 25, "therethough" should read --therethrough--.

Column 11, claim 6, line 11, "said" should read --each--.

Signed and Sealed this

*Twentieth* Day of *October 1981*

[SEAL]

*Attest:*

GERALD J. MOSSINGHOFF

*Attesting Officer*

*Commissioner of Patents and Trademarks*